United States Patent [19]

Carlin

[11] 4,171,248

[45] Oct. 16, 1979

[54] METHOD OF OPENING CHROME ORE

[75] Inventor: William W. Carlin, Portland, Tex.

[73] Assignee: PPG Industries, Inc., Pittsburgh, Pa.

[21] Appl. No.: 848,043

[22] Filed: Nov. 3, 1977

[51] Int. Cl.[2] ..... C25B 1/14

[52] U.S. Cl. ..... 204/89; 423/596; 75/1 R; 75/2

[58] Field of Search ..... 204/59; 423/596; 75/1 R, 2

[56] References Cited

U.S. PATENT DOCUMENTS

| | | | |
|---|---|---|---|
| 779,705 | 1/1905 | Gibbs | 204/89 |
| 802,205 | 10/1905 | Gibbs | 204/89 |
| 838,757 | 12/1906 | Suchy | 204/89 |
| 2,388,775 | 11/1945 | Udy | 423/596 |
| 2,410,242 | 10/1946 | Schulein | 204/89 |
| 2,436,940 | 3/1948 | Schulein | 204/130 |
| 2,493,789 | 1/1950 | Lidy | 423/596 |
| 2,601,306 | 6/1952 | Lloyd | 204/89 |
| 2,771,413 | 11/1956 | Dean et al. | 204/89 |
| 3,305,463 | 2/1967 | Carlin | 204/89 |
| 3,454,478 | 7/1969 | Carlin | 204/130 |
| 3,510,256 | 5/1970 | Schaper | 423/596 |
| 3,639,925 | 2/1972 | Scheiner et al. | 75/101 R |
| 3,859,412 | 1/1975 | Okabe et al. | 423/596 |
| 3,932,598 | 1/1976 | Cooper et al. | 423/596 |
| 3,980,751 | 9/1976 | Foulkes | 204/95 |

*Primary Examiner*—T. Tung

*Attorney, Agent, or Firm*—Richard M. Goldman

[57] ABSTRACT

Disclosed is a method of opening iron oxide-chromic oxide ores of trivalent chromium by contacting the ore with an aqueous alkali metal hypochlorite bleach and recovering a liquid containing hexavalent chromium from the reaction media. The hexavalent chromium produced by the bleaching action is normally in the form of alkali metal chromate. According to a preferred exemplification, the alkali metal chromate is electrolytically converted to an alkali metal dichromate.

12 Claims, 2 Drawing Figures

METHOD OF OPENING CHROME ORE

DESCRIPTION OF THE INVENTION

The production of sodium dichromate has normally been carried out utilizing chromite ore. The chromite ore has the approximate composition $FeO.Cr_2O_3$. This chromite ore normally is roasted with soda ash or potassium carbonate, with the consequent formation of sodium chromate or potassium chromate. The sodium chromate or potassium chromate is extracted from the calcined mixture as an alkali metal chromate solution and thereafter reacted with an acid to convert the monochromate to a dichromate. Both sulfuric acid and carbon dioxide have been used as the acid in the conversion of the alkali metal chromate solution to the alkali metal dichromate solution. Typical acid processes are disclosed in U.S. Pat. No. 2,612,435 for a sulfuric acid process and U.S. Pat. No. 2,931,704 for a carbonic acid process.

It has therefore now been found that chromite ore, $FeO.Cr_2O_3$, can be opened by the reaction of hypochlorite ion with the ore at temperatures below the boiling point of the aqueous hypochlorite solution.

It has also been found that the addition of calcium ion, for example, as the chloride, oxide, or hydroxide, in molar quantities equal to or greater than the iron content of the chromite ore increases the hypochlorite ion utilization.

It has further been found that the conversion of the alkali metal chromate-alkali composition that results from the opening of the ore by hypochlorite bleach may be converted to alkali metal dichromate by electrolysis in a permionic membrane cell.

THE DRAWINGS

DETAILED DESCRIPTION OF THE INVENTION

Disclosed is a method of opening chromite ore, typically having the nominal stoichiometric formula $FeO.Cr_2O_3$, by contacting the ore with an aqueous alkali metal hypochlorite bleach at a temperature below the boiling point of the bleach, thereby forming a reaction medium, e.g., a slurry of the ore in the bleach. The slurry is then separated into a solid fraction containing trivalent iron and trivalent chromium, and a liquid portion containing hexavalent chromium. The hexavalent chromium, along with alkali metal chloride from the bleach, may then, in a preferred exemplification, be passed to the anolyte compartment of an electrolytic cell. The anolyte liquor product of the electrolytic cell is alkali metal dichromate while the catholyte liquor product is alkali metal hydroxide. The gaseous anode product of the cell is chlorine which may be mixed with the alkali metal hydroxide from the catholyte to form additional alkali metal hydorchlorite bleach for recycle to the ore opening step.

Figure 1:
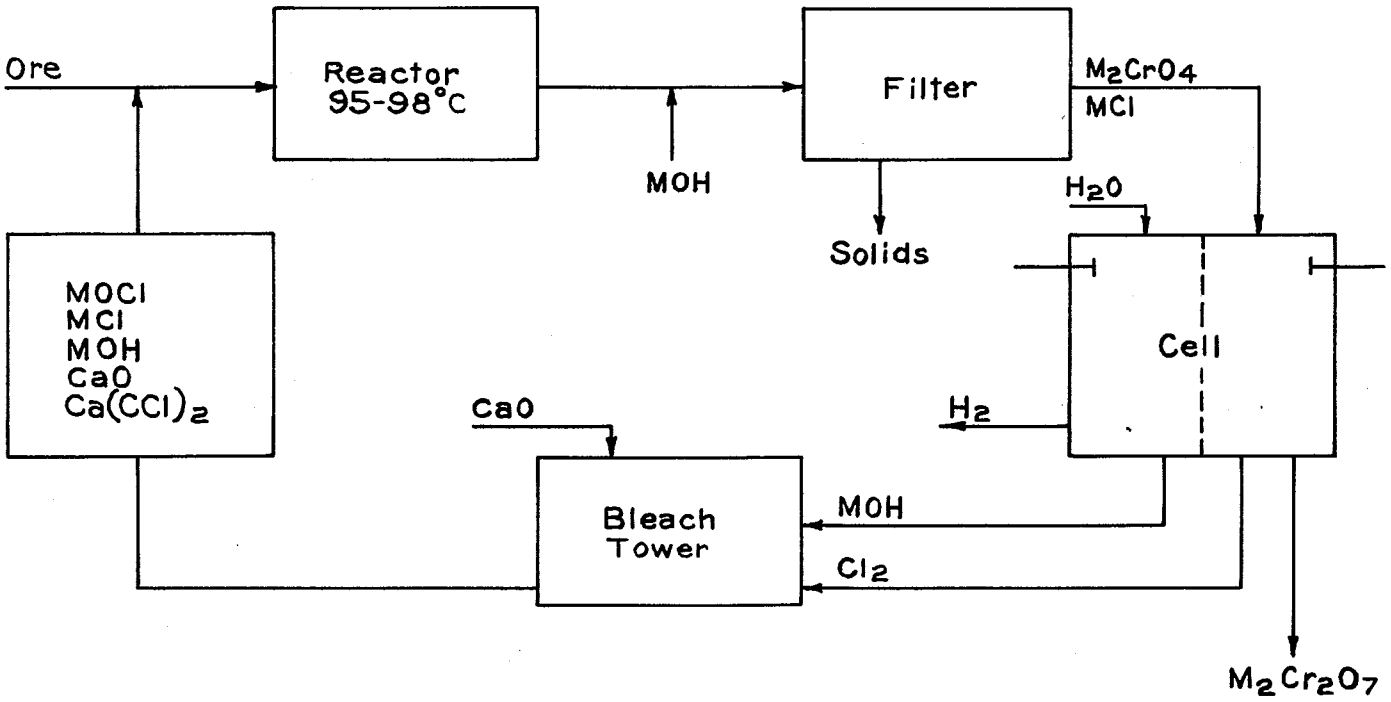
FIG. 1 shows a flow diagram for the opening of chromite ore with hypochlorite bleach.

The method of this invention is illustrated with particularity in FIG. 1 where chromite ore, $FeO.Cr_2O_3$, is contacted with a hypochlorite bleach, for example, a bleach containing sodium hypochlorite, sodium chloride, sodium hydroxide, clacium hydroxide, and calcium hypochlorite. The temperature of the bleach is normally maintained below the boiling point thereof, for example, below about 95° to 98° Centigrade and the slurry of bleach and ore typically is maintained for a long enough period of time to allow substantially all of the trivalent chromium to be converted to hexavalent chromium. The contact time necessary to accomplish complete conversion of the trivalent chromium to hexavalent chromium depends upon the degree of comminution of the ore. For example, for a minus 100 mesh, U.S. standard sieve size, ore this may be on the order of two or three hours or more, whereas for a minus 325 mesh, U.S. standard sieve size, ore this may be on the order of about one hour.

After the desired degree of conversion of the trivalent chromium to hexavalent chromium is attained, the pH of the slurry or reaction medium is adjusted to strongly alkaline range, for example, above 8 and preferable above about 10, for example, by the addition of alkali metal hydroxide. Normally, the alkali metal hydroxide added to the slurry is the same as the alkali metal as the alkali metal of the alkali metal hypochlorite bleach.

The pH adjusted alkaline slurry is then filtered whereby to separate the slurry into liquid and solid fractions. The solid fraction normally contains solid particles of divalent and trivalent iron as well as solid particles of any nonreacted trivalent chromium. The liquid filtrate is hexavalent chromium, normally an alkali metal chromate salt, and alkali metal chloride.

Figure 2:
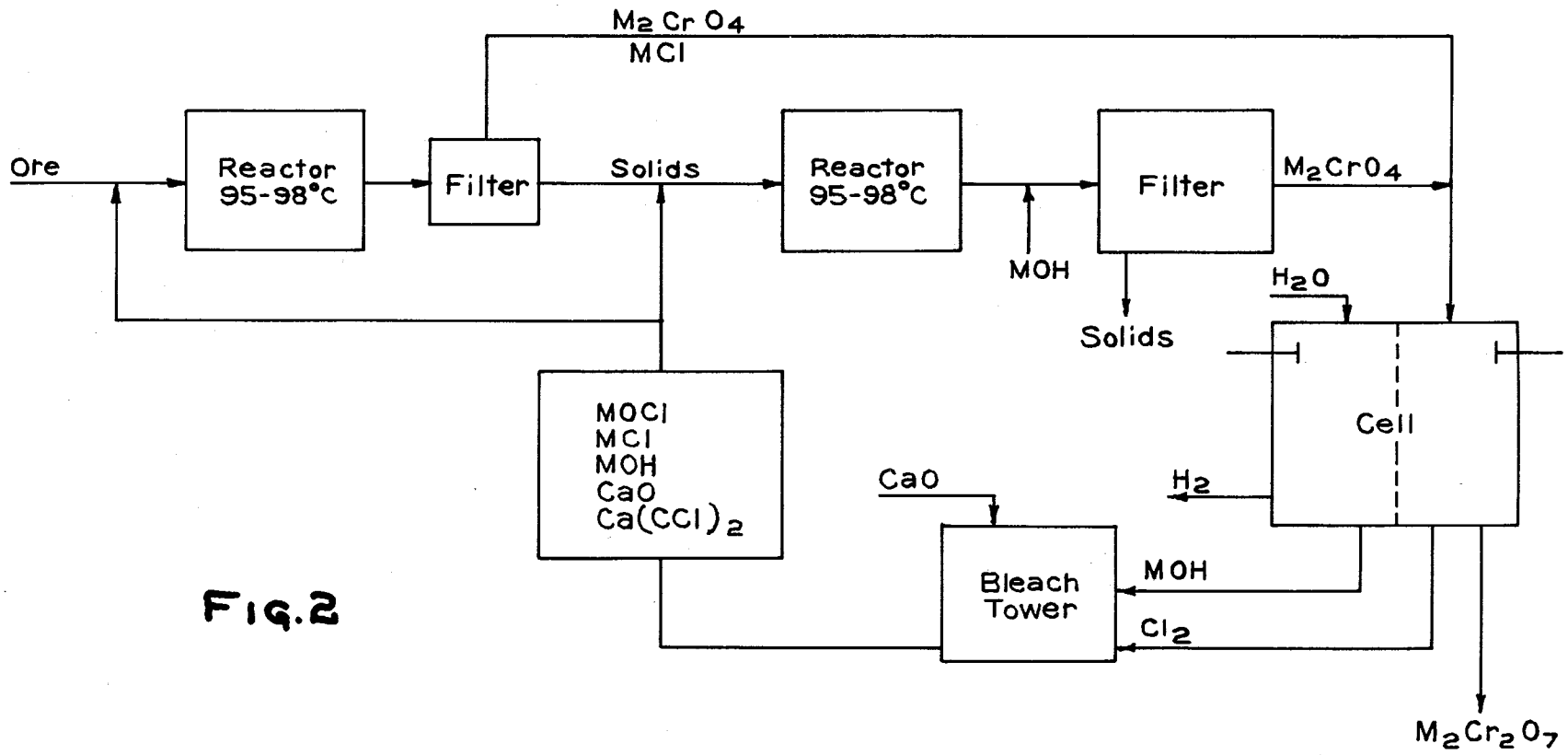
FIG. 2 is a flow chart for the chromite ore opening with hypochlorite ion where the ore is contacted in a plurality of stages with the hypochlorite ion bleach.

According to a preferred exemplification of this invention, the aqueous alkali metal chromate solution, $M_2CrO_4$, also containing alkali metal chloride, is fed to the anolyte compartment of an electrolytic cell while water is fed to the catholyte compartment of the electrolytic cell. An electrical current is caused to pass through the electrolytic cell, shown generally in FIGS. 1 and 2. The anode products of the cell are gaseous chlorine and the alkali metal dichromate corresponding to the feed, for example, sodium dichromate, $Na_2Cr_2O_7$, when the bleach is sodium hypochlorite. The cathode products of the cell are gaseous hydrogen and the alkali metal hydroxide corresponding to the feed.

The alkali metal dichromate, $M_2Cr_2O_7$, is recovered from the anolyte compartment of the cell for subsequent processing or use in commerce. The alkali metal hydroxide from the catholyte compartment and chlorine from the anolyte compartment may be reacted, for example by contact in a bleach tower as shown generally in FIGS. 1 and 2, whereby the alkali metal and chlorine are recycled and subsequently contacted with additional iron chromite ore.

Returning to the individual steps of the process, the ore, iron chromite having a nominal stoichiometric formula of $FeO.Cr_2O_3$ is comminuted to a size of minus 100 mesh, U.S. standard sieve size, and preferably to minus 325 mesh, U.S. standard sieve size. Either before or after comminution, but before contact with the bleach, the ore may be treated by various physical separation means to remove aluminates, silicates, and the like therefrom. The ore, comminuted, and separated from less dense and more dense fractions, is fed to a suitable reactor where it is reacted with the bleach.

The bleach is an alkali metal hypochlorite bleach. By an alkali metal hypochlorite bleach is meant a bleach having the formula $MOCl$ where M is an alkali metal, generally sodium or potassium. This reaction is normally carried out at a temperature below the boiling point of the bleach, for example, from about 95° to about 100° Centigrade, whereby to produce alkali metal chromate, $M_2CrO_4$. The stoichiometry is such that normally about 2.5 to about 3.2 moles of alkali metal hypochlorite is required to produce one mole of alkali metal chromate, $M_2CrO_4$. Thus, in the case of sodium hypochlorite, about 0.93 to about 1 pound of sodium hypochlorite is required to produce one pound of sodium chromate, $Na_2CrO_4$.

The concentration of bleach should generally be from about 6 weight percent to about 15 weight percent and in the case of sodium hypochlorite bleach preferably above about 10 weight percent, for example, 13 weight percent, sodium hypochlorite.

According to an alternative exemplification, lime may also be added to the reaction medium or slurry of bleach and ore. Generally, when lime is added, the addition should be 20 weight percent, as calcium oxide on a dry ore basis, whereby to increase the alkali metal hypochlorite utilization. Amounts less than about 20 weight percent, as calcium oxide on a dry ore basis, have some positive effect in reducing the need for hypochlorite ion and increasing the overall utilization thereof, while amounts in excess of about 20 weight percent, basis calcium oxide on a dry ore basis, do not appear to have any additional incremental positive effect.

According to an alternative exemplification, multistage leaching of the ore with alkali metal hypochlorite bleach may also be used. Thus, a multi-stage countercurrent reactor could be utilized with strong bleach reacting with almost completely opened ore and progressively weaker bleach reacting with less open ore. According to a still further exemplification, illustrated in FIG. 2, bleach could be added in parallel to a series of stages of the reactor.

After the ore has been open to substantially desired extent, for example, in excess of 80 percent opening and preferably as much as 85 or 88 percent opening, the pH of the slurry is adjusted from the acidic level of about pH 3 of the bleaching slurry to an alkaline pH preferably a pH greater than 8 and most preferably a pH of about 10. This may be accomplished by hydroxyl ion to slurry, i.e., by adding an alkali metal hydroxide to the slurry. Generally the alkali metal hydroxide is the hydroxide of the same alkali metal as the alkali metal of the bleach. For example, sodium hydroxide where the bleach is sodium hypochlorite, or potassium hydroxide where the bleack is potassium hypochlorite. The amount of alkali metal hydroxide added is an amount sufficient to attain the desired pH, for example, an amount sufficient to attain a pH of about 10.

Thereafter, the slurry is passed through a filter and separated into a solid portion and a liquid portion. The liquid portion contains alkali metal chromate, for example, sodium chromate or potassium chromate as well as the corresponding alkali metal chloride, for example, potassium chloride or sodium chloride. The solid portion contains iron, usually trivalent iron, as well as unreacted or unopened trivalent chromium usually as chromic oxide $Cr_2O_3$. The chromate liquor of the filtrate may be fed to an electrolytic cell for conversion from alkali metal chromate to alkali metal dichromate.

Alkali metal dichromate of high purity and high yield may be produced from alkali metal chromate in the anode compartment of an electrolytic cell. Particularly preferred are electrolytic cells where the anolyte compartment thereof is separated from the catholyte compartment by a permionic membrane.

According to a preferred exemplification of this invention, alkali metal dichromate is produced by feeding an alkali metal chromate of a strongly alkaline pH, for example, a pH of about 10, to the anolyte compartment of an electrolytic cell and withdrawing an anolyte liquor having a pH of from about 1.5 to about 5 and preferably a pH between about 2.5 and 5.

The alkali metal chromate, usually sodium chromate or potassium chromate, is normally added to the cell as an aqueous slurry or an aqueous solution. When added as an aqueous solution, the aqueous solution has a $CrO_3$ content of from about 50 to about 550 grams per liter and preferably from about 290 to about 350 grams per liter.

During the course of electrolysis the sodium ion passes through the permionic membrane to the catholyte compartment thereby providing an anolyte compartment liquor having a pH of from about 1.5 to about 5 as described above. The liquor contained within the anolyte compartment is an aqueous solution containing essentially alkali metal dichromate, for example, sodium dichromate.

The anolyte liquor may be commercially utilized or may be further treated. For example, solid anhydrous sodium dichromate may be obtained by evaporating the solution, for example, at a temperature above about 100° Centigrade. Alternatively, a concentrated solution may be attained by partial evaporation, for example, a 70 weight percent aqueous sodium dichromate solution.

The catholyte liquor generally contains from about 5 to about 12 weight percent alkali metal hydroxide, for example, sodium hydroxide. Water, free of substantial amounts of other anions, is normally added to the catholyte compartment in order to avoid the back migration of sodium ions through the permionic membrane.

The electrolytic cell has an anode and a cathode separated by a permionic membrane. Preferably, the permionic membrane is a perfluorinated, polymeric sulfonyl permionic membrane. One particularly exemplary permionic membrane is a DuPont NAFION membrane.

The fluoro- polymers utilized in forming DuPont NAFION® membranes have pendant side chains with sulfonyl groups attached to carbon atoms which carbon atoms have at least one fluorine atom connected thereto. NAFION polymers are comprised of monomeric precursors which are fluorinated or fluorine substituted vinyl compounds. More particularly NAFION® polymers comprise at least two monomeric precursors with at least one group of monomeric units coming from each of two groups. The first group are fluorinated vinyl compounds such as vinyl fluoride, hexafluoropropylene, vinylidene fluoride, trifluoroethylene, chlorotrifluoroethylene, perfluoro (alkyl vinyl ether), tetrafluoroethylene, and mixtures thereof. Preferably the precursor vinyl monomer is substantially free of hydrogen.

The second group of monomers are sulfonyl containing monomers containing the precursor-$SO_2F$ or -$SO_2Cl$. One such comonomer is $CF_2{=}CFSO_2F$. Other examples are represented by the general formula $CF_2{=}CFR_fSO_2F$ where $R_f$ is a bifunctional perfluorinated radical containing 2 to 8 carbon atoms. The particular chemical content of the structure of the radical linking the sulfonyl group to the copolymer chain is not critical but the structure must have a fluorine atom attached to the carbon atom through which is attached the sulfonyl group. If the sulfonyl group is attached directly to the chain, the carbon to which it is attached must have the fluorine attached to it. Other atoms connected to the carbon to which the sulfonyl group is attached can be fluorine, chlorine, or hydrogen, with chlorine or fluorine being preferred.

The $R_f$ radical of the formula can either be branched or unbranched, that is, straight chain, and can have one or more ether linkages therein. It is preferred that the vinyl radical of the group of sulfonyl fluoride containing comonomers be joined to the $R_f$ group through an ether linkage so that the comonomer can be of the formula $CF_2{=}CFOR_fSO_2F$. Illustrative of such sulfonyl fluoride containing comonomers are $$CF_2{=}CFOCF_2CF_2SO_2F,$$

$$CF_2{=}CFOCF_2\underset{\underset{CF_3}{|}}{C}FOCF_2CF_2SO_2F,$$

$$CF_2{=}CFOCF_2\underset{\underset{CF_3}{|}}{C}FO\,CF_2\underset{\underset{CF_3}{|}}{C}\,O\,CF_2CF_2SO_2F,$$

$$CF_2{=}CFCF_2CF_2SO_2F, \text{ and}$$

$$CF_2{=}CFO\,CF_2\underset{\underset{\underset{\underset{CF_3}{|}}{O}}{\underset{CF_2}{|}}}{C}F\,O\,CF_2CF_2SO_2F$$

The preferred sulfonyl fluoride containing comonomer is perfluoro (3,6-dioxa-4 methyl-7-octene sulfonyl fluoride) having the general formula $$CF_2{=}CFO\,CF_2\underset{\underset{CF_3}{|}}{C}F\,O\,CF_2CF_2SO_2F.$$

The sulfonyl-containing monomers useful in providing permionic membranes useful in the practice of this invention are described in U.S. Pat. No. 3,282,875 to Connolly et al, U.S. Pat. No. 3,041,317 to Gibbs, and U.S. Pat. No. 3,718,627 to Grot et al.

Preferred as copolymers in providing the permionic membrane useful in the practice of this invention are perfluorocarbon copolymers. Particularly preferred is the copolymer of tetrafluoroethylene and perfluoro (3,6-dioxa-4-methyl-7-octene sulfonyl fluoride) which comprises 10 to 60 percent, and preferably 25 to 50 percent by weight of the sulfonyl fluoride.

The permionic membrane maybe a sheet of the membrane material. Alternatively, the barrier may be a solid material over which is coated the proper permionic material such as organic plastic materials coated on substrates or self-supporting films of organic plastic materials such as asbestos diaphragms impregnated with organic polymeric materials.

Preferably, the permionic membrane serves to allow the passage of alkali metal ions, such as sodium ions and potassium ions, through the permionic membrane but substantially prevents the transmission of chromate ions through the permionic membrane.

The anode may be formed of any material that is resistant to concentrated dichromate solutions under anodic conditions at strongly acidic pH levels. Typical materials useful as an anode in carrying out the method of this invention include lead dioxide, lead dioxide on graphite, lead dioxide on titanium, precious metal coated titanium, and precious metal oxide coated titanium. Exemplary precious metal coated titanium anodes include platinum coated titanium, and platinum-irridium on titanium. Exemplary precious metal oxide coated titanium anodes include irridium oxide, $IrO_2$, coated titanium, and ruthenium oxide, $RuO_2$, coated titanium. When coatings comprising oxides of platinum group metals are referred to it is to be understood that such coatings normally comprise an oxy compound, in the rutile crystal form, of the platinum group metal present with an oxy compound, also in the rutile crystal form, of titanium. Additionally, third components, as lead compounds or tin compounds may be present in the coating.

The cathode may be formed of a material that is chemically resistant to concentrated alkali metal hydroxide solutions. Such materials include iron cathodes and steel cathodes.

According to the method of this invention, the alkali metal chromate-alkali metal chloride liquid recovered as filtrate from the bleach is fed to the anolyte compartment of the electrolytic cell while water is fed to the catholyte compartment of the electrolytic cell. An electrical current is passed through the electrolytic cell, for example, at a current density of form about 90 to about 190 amperes per square foot. Hydrogen is formed at the cathode and chlorine at the anode, while alkali metal dichromate is formed in the anolyte liquor and alkali metal hydroxide is formed in the catholyte liquor. The alkali metal dichromate is recovered from the cell as described above. Alkali metal hydroxide from the catholyte liquor as described above. Alkali metal hydroxide from the catholyte liquor is then contacted with chlorine from the anolyte whereby to form additional alkali metal hypochlorite bleach with which further iron-chromite ore may be opened.

According to the method of this invention chromium ore having a nominal content of 53 weight percent $Cr_2O_3$, 19 weight percent Fe, 12 weight percent Al, 12 weight percent MgO, and 0.75 weight percent total $SiO_2$ and $V_2O_5$, was comminuted to minus 325 mesh, U.S. standard sieve size. A slurry of the comminuted ore, 13 weight percent NaOCl solution, and $Ca(OH)_2$ was prepared and allowed to stand at 90 degrees Centigrade for one hour, at a pH of 3.

Sodium hydroxide, at 50 weight percent concentration, was added to the slurry to adjust the pH thereof to pH 10. The slurry was then filtered, and the solids washed with water. The solids were returned to an NaOCl slurry.

The liquid, at a pH of 10, and a $Na_2CrO_4$ content of about 550 grams per liter, was fed to the anolyte compartment of an electrolytic cell. An electrical current was passed through the cell. Chlorine was evolved at the anode. Chlorine gas and an anolyte liquor containing approximately 525 grams per liter of $Na_2Cr_2O_7$ are recovered from the anolyte compartment of the cell. Hydrogen gas is evolved at the cathode, and a cathode liquor containing about 12 weight aqueous sodium hydroxide is recovered from the catholyte compartment.

The $Na_2Cr_2O_7$ may thereafter be utilized as recovered, or further concentrated. The chlorine and sodium hydroxide are mixed together, e.g., in a bleach tower, to produce additional bleach for use in the process.

EXAMPLE I

A series of tests were conducted to determine the effect of NaOCl concentration on the degree of opening of $FeO.Cr_2O_3$ ore.

The chromite ore had the following composition:

| Analysis of Ore | |
|---|---|
| Constituent | Weight Percent |
| $Cr_2O_3$ | 45.54 |
| CaO | 0.42 |
| FeO | 19.62 |
| $Al_2O_3$ | 12.54 |
| MgO | 12.00 |
| $V_2O_5$ | 0.27 |
| $SiO_2$ | 0.47 |

The chromite ore was ground to minus 325 mesh, U.S. standard sieve size. A weighed portion of ground ore and ground CaO was added to a measured amount of aqueous NaOCl in a glass beaker. The slurry was maintained at 90 degrees Centigrade for times indicated in the table. At the completion of the run the pH of the slurry was adjusted to pH=10 by the addition of 50 weight percent NaOH. The slurry was then filtered through "Reeve-Angle 934 AH" glass filter paper. The solids were then washed with the deionized water and resulting yellow liquid, containing Cr(VI) was collected. The filtrate and wash water were then analyzed for Cr(VI). The results are shown below.

| Opening of Chromite Ore As A Function of NaOCl Concentration | | | | | | |
|---|---|---|---|---|---|---|
| NoOCl (grams) (Anhydrous basis) | Strength of NaOCl (Wt. %) | CaO (grams) | Ore (grams) | Reaction Time (hours) | Percent Ore Opening | Grams of NaOCl per gram of $Na_2CrO_4$ Produced |
| 4.97 | 13% | 2.0 | 10.0 | 1 | 29.1% | 1.76 |
| 5.00 | 5% | 2.0 | 10.0 | 1 | 21.1% | 2.44 |
| 4.97 | 13% | 2.0 | 10.0 | 2 | 54.9% | .93 |
| 5.00 | 5% | 2.0 | 10.0 | 2 | 48.1% | 1.07 |

EXAMPLE II

A series of tests were conducted to determine the effect of lime content on the degree of opening of the chromite ore.

The chromite ore prepared in Example I was utilized. The procedure described in Example I was followed, except that ten grams of ore were added to a sufficient amount of a 13 weight percent NaOCl solution to provide 5.0 grams of NaOCl (anhydrous basis). The results shown below were obtained.

| Opening of Chromite Ore As a Function of CaO Concentration | | | |
|---|---|---|---|
| CaO (grams) | Reaction Time (grams) | Percent Ore Opening,% | Grams of NaOCl per grams of $Na_2CrO_4$ Produced |
| 1 | 2 | 51.0 | 1.00 |
| 2 | 2 | 54.9 | 0.93 |
| 4 | 2 | 52.6 | 0.97 |

EXAMPLE III

A series of tests were conducted to determine the effect of multistage contacting on the degree of ore opening.

The chromite ore prepared in Example I was utilized. In Run A 10 grams of ore and 2 grams of CaO were reacted with 4.9 grams (anhydrous basis) of NaOCl in a 13 weight percent solution for 1 hour at 95 degrees Centigrade. The solids were then separated and reacted with 4.9 grams (anyhdrous basis) of NaOCl in a fresh 13 weight percent in each subsequent stage for 1 hour at 95 degrees Centigrade. In Run B 10 grams of ore and 2 grams of CaO were reacted with 2.5 grams (anhydrous basis) of NaOCl in a 13 weight percent solution for 1 hour at 95 degrees Centigrade. The solids were then separated and reacted with 2.5 grams (anhydrous basis) of NaOCl in a fresh 13 weight percent in each subsequent stage for 1 hour at 95 degrees Centigrade.

The results obtained are shown below.

| Multi Stage Contacting | | | | |
|---|---|---|---|---|
| Run | NaOCl per Stage (grams) (Anhydrous basis) | Stage | Ore Opening (%) | Grams of NaOCl per Grams of $Na_2CrO_4$ Produced |
| A | 4.9 | 1 | 31.4 | 1.61 |
| | 4.9 | 2 | 59.5 | 1.69 |
| | 4.9 | 3 | 79.7 | 1.90 |
| | 4.9 | 4 | 88.5 | 2.25 |
| | 4.9 | 5 | 88.6 | 2.85 |
| B | 2.5 | 1 | 22.1 | 1.17 |
| | 2.5 | 2 | 48.9 | 1.05 |
| | 2.5 | 3 | 77.2 | 1.00 |
| | 2.5 | 4 | 88.5 | 1.16 |
| | 2.5 | 5 | 88.4 | 1.46 |

While the invention has been described with reference to specific exemplifications and embodiments thereof, the invention is not to be so limited except as in the claims appended hereto.

I claim:

1. A method of opening $FeO.Cr_2O_3$ ore comprising the steps of:

contacting the ore with an aqueous alkali metal hypochlorite solution below the boiling point of said solution whereby to form an aqueous acidic slurry; and recovering a liquid containing hexavalent chromium from said aqueous slurry.

2. The method of claim 1 comprising recovering a solid containing trivalent iron from said aqueous slurry.

3. The method of claim 2 comprising contacting the ore with aqueous alkali metal hypochlorite solution, separating the solids from the liquid and thereafter contacting the solids with aqueous alkali metal hypochlorite solution.

4. The method of claim 1 comprising adjusting the pH of the aqueous slurry to at least pH = 10 after opening the ore whereby to render said slurry alkaline and thereafter recovering a liquid from said aqueous slurry.

5. The method of claim 4 comprising adding alkali metal hydroxide to the aqueous slurry.

6. The method of claim 1 comprising contacting the ore with from about 2.5 to about 3.2 moles of alkali metal hypochlorite per mole of chromium and thereafter recovering a liquid from said aqueous slurry.

7. The method of claim 1 comprising feeding the liquid containing hexavalent chromium to an anolyte chamber of an electrolytic cell, feeding water to a catholyte chamber of the cell, passing an electrical current through the cell, recovering hydrogen and alkali metal hydroxide from the catholyte chamber of the cell, and recovering chlorine and alkali metal dichromate from the anolyte chamber of the cell.

8. The method of claim 7 comprising contacting alkali metal hydroxide and chlorine from said electrolytic cell whereby to form aqueous alkali metal hypochlorite solution and thereafter contacting $FeO.Cr_2O_3$ ore with the aqueous alkali metal hypochlorite solution formed thereby.

9. A method of opening $FeO.Cr_2O_3$.ore comprising the steps of:

contacting ore particles with an aqueous alkali metal hypochlorite solution below the boiling point of said solution whereby to form a slurry of ore particles and bleach;

thereafter adjusting the pH of the slurry to at least pH = 10;

filtering the pH adjusted slurry whereby to separate iron rich solids from an alkali metal chromate-alkali metal chloride liquid;

feeding the alkali metal chromate-alkali metal chloride liquid to an anolyte chamber of an electrolytic cell, feeding water to a catholyte chamber of the electrolytic cell, passing an electrical current through the electrolytic cell, recovering hydrogen and alkali metal hydroxide from the catholyte chamber of the cell, and recovering chlorine and alkali metal dichromate from the anolyte chamber of the cell;

contacting alkali metal hydroxide and chlorine from said cell whereby to form aqueous alkali metal hypochlorite solution; and thereafter contacting $FeO.Cr_2O_3$ ore with said aqueous alkali metal hypochlorite solution.

10. The method of claim 9 comprising contacting the ore with aqueous alkali metal hypochlorite solution whereby to form said slurry, separating the liquid from the solid, and therafter contacting the solid with aqueous alkali metal hypochlorite solution.

11. The method of claim 9 comprising contacting the ore with from about 2.5 to about 3.2 moles of alkali metal hypochlorite solution per mole of chromium.

12. A method of opening $FeO.Cr_2O_3$ ore comprising the steps of:

contacting ore particles with an aqueous alkali metal hypochlorite solution below the boiling point of said solution whereby to form an acidic slurry of ore particles and aqueous alkali metal hypochlorite solution:

thereafter adjusting the pH of the slurry to at least ph = 10;

filtering the pH adjusted slurry whereby to separate iron rich solids from an alkali metal chromate-alkali metal chloride liquid; and feeding the alkali metal chromate-alkali metal chloride liquid to an anolyte chamber of an electrolytic cell, feeding water to a catholyte chamber of the electrolytic cell, passing an electrical current through the electrolytic cell, recovering hydrogen and alkali metal hydroxide from the catholyte chamber of the cell, and recovering chlorine and alkali metal dichromate from the anolyte chamber of the cell.

* * * * *